US011459938B2

(12) United States Patent
Kodama et al.

(10) Patent No.: US 11,459,938 B2
(45) Date of Patent: Oct. 4, 2022

(54) INTERNAL COMBUSTION SYSTEM

(71) Applicant: TOYOTA JIDOSHA KABUSHIKI KAISHA, Toyota (JP)

(72) Inventors: Yasuaki Kodama, Seto (JP); Yoichiro Yoshii, Shizuoka (JP); Masayuki Nagasawa, Shizuoka (JP); Shinichi Ogura, Shizuoka (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/552,589

(22) Filed: Dec. 16, 2021

(65) Prior Publication Data

US 2022/0195911 A1 Jun. 23, 2022

(30) Foreign Application Priority Data

Dec. 22, 2020 (JP) ..... JP2020-212018

(51) Int. Cl.

| | |
|---|---|
| ***F01P 11/14*** | (2006.01) |
| ***F01P 7/14*** | (2006.01) |
| ***F01P 11/06*** | (2006.01) |
| ***F01P 11/16*** | (2006.01) |
| ***F01P 3/00*** | (2006.01) |

(52) U.S. Cl.

CPC ..... *F01P 11/14* (2013.01); *F01P 3/00* (2013.01); *F01P 2003/001* (2013.01); *F01P 2025/32* (2013.01)

(58) Field of Classification Search

CPC .... F01P 7/14; F01P 11/06; F01P 11/16; F01P 2003/001

See application file for complete search history.

(56) References Cited

U.S. PATENT DOCUMENTS 4,946,595 A * 8/1990 Miller, Jr. ..... F01P 11/06 210/759
5,571,420 A * 11/1996 Creeron ..... F01P 11/06 123/41.14
5,820,752 A * 10/1998 Berke ..... C09K 5/20 210/221.2

(Continued)

FOREIGN PATENT DOCUMENTS

JP 2009087825 A 4/2009

OTHER PUBLICATIONS

Yasuaki Kodama, U.S. Appl. No. 17/399,341, filed Aug. 11, 2021.

*Primary Examiner* — Long T Tran
(74) *Attorney, Agent, or Firm* — Dickinson Wright, PLLC

(57) ABSTRACT

An internal combustion system includes a control device having an accumulated amount of time measuring unit that measures an accumulated amount of time by measuring an amount of time when the temperature of the coolant measured by a temperature sensor is equal to or higher than a defined temperature and accumulating the amount of time measured, an exchange determination unit that determines that the coolant needs to be exchanged when the measured accumulated amount of time reaches or exceeds an upper-limit accumulated amount of time, and an upper-limit amount of time setting unit that sets the upper-limit accumulated amount of time for determination by the determination unit in accordance with the type of metal forming the flow channel where the coolant flows.

2 Claims, 3 Drawing Sheets

(56) References Cited

U.S. PATENT DOCUMENTS

| | | | | |
|---|---|---|---|---|
| 2007/0298291 | A1* | 12/2007 | Nishii | H01M 8/04029 429/492 |
| 2014/0023107 | A1* | 1/2014 | Furuta | F01P 11/16 374/4 |
| 2016/0333829 | A1* | 11/2016 | Takahashi | F02D 41/005 |
| 2018/0068497 | A1* | 3/2018 | Kurtz | F02D 41/021 |
| 2018/0274429 | A1* | 9/2018 | Quix | F01P 11/20 |

* cited by examiner

INTERNAL COMBUSTION SYSTEM

CROSS REFERENCE TO RELATED APPLICATIONS

The present application claims priority from Japanese patent application JP 2020-212018 filed on Dec. 22, 2020, the entire content of which is hereby incorporated by reference into this application.

BACKGROUND

Technical Field

The present disclosure relates to an internal combustion system including an engine.

Background Art

Internal combustion systems including an engine as a power source and a control device that controls the engine have conventionally been proposed. The engine generates a high-temperature heat due to combustion of a fuel-air mixture during the operation. Thus, a coolant is introduced into the engine so as to be circulated by a cooling circulation mechanism to be delivered to the engine.

Some of such coolants to be used may include ethylene glycol for freeze prevention. However, ethylene glycol may be oxidatively degraded under an environment at a temperature exceeding 80° C. in some cases.

As a system that controls such a coolant, a system is disclosed that accumulates the amount of time when the temperature of the coolant is equal to or higher than a given temperature and determines the degradation of the coolant when the accumulated amount of time has reached a defined amount of time.

SUMMARY

However, when such a coolant is oxidatively degraded, causing an organic acid to increase, the surface of the cooling circulation mechanism where the coolant contacts may occasionally corrode due to the organic acid. In such a case, as in JP 2009-087825 A, in which the amount of time when the coolant is at high temperatures is accumulated and the coolant exchange is prompted when the accumulated amount of time reaches or exceeds a threshold, the flow channel of the coolant could have already excessively corroded at the time of coolant exchange. This is because the threshold is set considering the conductivity of the coolant irrespective of the corrosion.

The present disclosure has been made in view of the foregoing, and provides an internal combustion system capable of suppressing corrosion of a flow channel where a coolant flows by exchanging the coolant containing ethylene glycol at appropriate timing.

An internal combustion system according to the present disclosure includes: an engine; a cooling circulation mechanism that circulates a coolant to the engine while cooling the coolant, the coolant adapted to cool the engine and containing ethylene glycol; a temperature sensor that measures a temperature of the coolant having passed through the engine; and a control device having: a measuring unit that measures an accumulated amount of time by measuring an amount of time when the temperature of the coolant measured by the temperature sensor is equal to or higher than a defined temperature and accumulating the amount of time measured; a determination unit that determines that the coolant needs to be exchanged when the accumulated amount of time measured reaches or exceeds an upper-limit accumulated amount of time; and a setting unit that sets the upper-limit accumulated amount of time for determination by the determination unit in accordance with a type of metal forming a flow channel where the coolant flows in the cooling circulation mechanism.

According to the present disclosure, the coolant flowing through the cooling circulation mechanism contains ethylene glycol, and thus, produces an organic acid from the ethylene glycol when the temperature is equal to or higher than a defined temperature due to heat transmitted from the engine or the like. When such production of the organic acid continues, the concentration of the organic acid contained in the coolant increases. Thus, in the present disclosure, an accumulation unit accumulates (adds up) the amount of time that satisfies the condition for producing the organic acid (specifically, the condition that the temperature is equal to or higher than the temperature at which the organic acid is produced) to measure the accumulated amount of time.

When the accumulated amount of time measured by the accumulation unit reaches or exceeds a set upper-limit accumulated amount of time, the concentration of the organic acid increases, causing the corrosion of the flow channel where the coolant flows to progress. This allows the determination unit to determine that the coolant needs to be exchanged.

In particular, in the present disclosure, the setting unit sets the upper-limit accumulated amount of time in accordance with the type of metal forming the flow channel where the coolant flows in the cooling circulation mechanism. This enables the coolant exchange at appropriate timing in accordance with the type of metal forming the flow channel, so that excessive corrosion of the flow channel where the coolant flows due to the organic acid contained in the coolant can be prevented.

Further, the setting unit may set the upper-limit accumulated amount of time for determination by the determination unit in accordance with the type of metal forming the flow channel where the coolant flows. However, in some embodiments, the setting unit may set the upper-limit accumulated amount of time separately for cast iron in a case where the metal forming the flow channel includes the cast iron and for another metal in a case where the metal forming the flow channel does not include the cast iron, and may set the upper-limit accumulated amount of time for the cast iron to be shorter than the upper-limit accumulated amount of time for the other metal.

As will be described later, the experiments conducted by the inventors have proven that cast iron is more likely to corrode due to the organic acid as compared to the other metals. Therefore, according to this embodiment, for a case where the metal forming the flow channel where the coolant flows includes cast iron, the upper-limit accumulated amount of time is set shorter than those for metals other than cast iron, so that the corrosion of a portion including cast iron due to the organic acid can be reduced.

The "metal forming the flow channel that includes cast iron" used herein means that at least one of the components forming the flow channel where the coolant flows, such as piping and a valve body, is formed of cast iron. The "metal forming the flow channel that does not include cast iron" means that none of the components forming the flow channel where the coolant flows, such as piping and a valve body, is formed of cast iron.

According to the present disclosure, a coolant containing ethylene glycol is exchanged at appropriate timing, so that the corrosion of a channel where the coolant flows can be suppressed.

DETAILED DESCRIPTION

The following will describe an embodiment according to the present disclosure with reference to FIG. 1 to FIG. 5.

Figure 1:
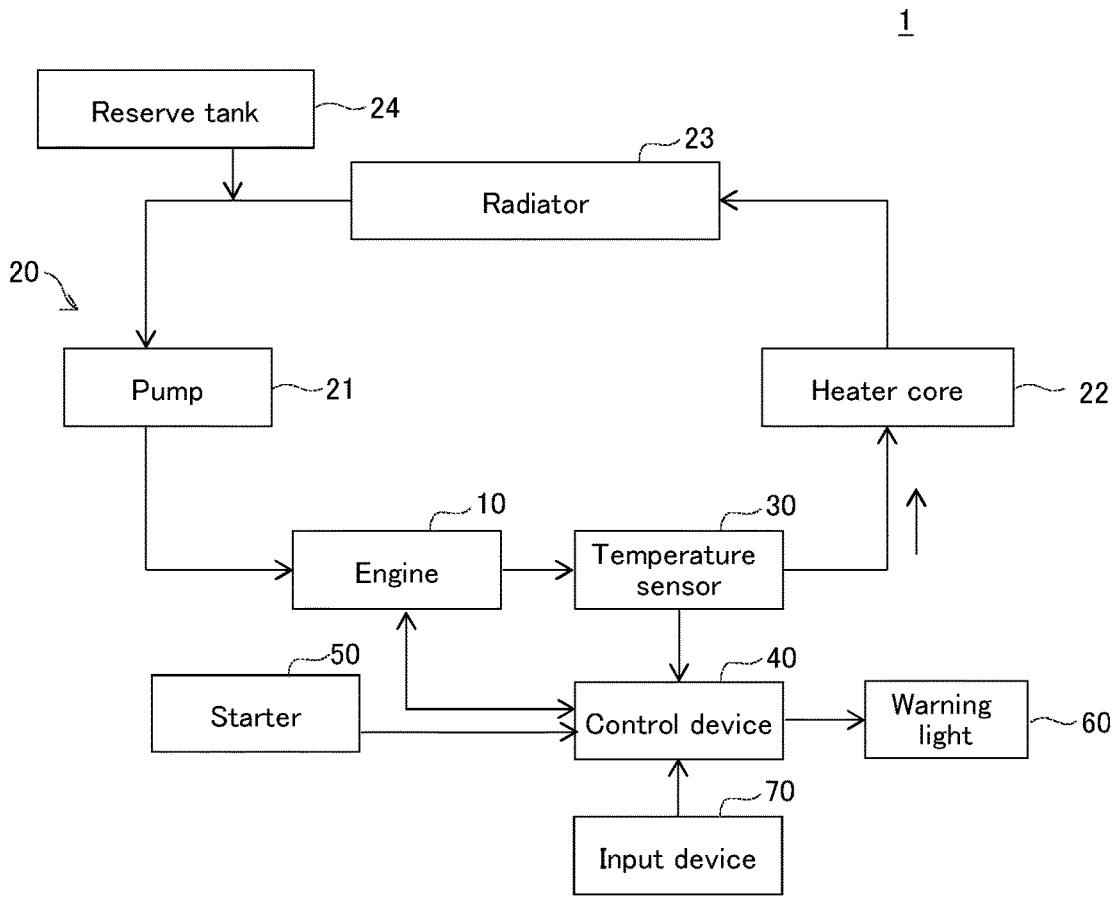
FIG. 1 is a schematic conceptual view of an internal combustion system according to an embodiment of the present disclosure.

As shown in FIG. 1, an internal combustion system 1 according to the present embodiment is to be mounted on a vehicle. The internal combustion system 1 includes an engine 10, a cooling circulation mechanism 20, and a control device 40. The internal combustion system 1 further includes a temperature sensor 30, a starter 50, a warning light 60, and an input device 70.

The engine 10 is a device as a power source of a vehicle. Although the details of the engine 10 are not illustrated below, the engine 10 has a cylinder block in which a piston is slidably disposed, and the cylinder head is provided with an intake valve and an exhaust valve. A mixture of fuel and intake air is ignited for combustion in a combustion chamber of the engine 10 so that the engine 10 is driven. Since the engine 10 is heated due to the combustion, a flow channel where a coolant for cooling the engine flows is formed in the cylinder block of the engine 10 in the present embodiment.

In the present embodiment, the coolant is a liquid in which an additive containing ethylene glycol or the like is added to water. The coolant in the present embodiment may contain 25 to 80 percent by mass of ethylene glycol. Addition of the ethylene glycol to the coolant can prevent the coolant from freezing.

The coolant for cooling the engine 10 is circulated to the engine 10 by the cooling circulation mechanism 20, which is a generally-known mechanism. The cooling circulation mechanism 20 includes a pump 21, a heater core 22, a radiator 23, and a reserve tank 24 that are coupled together via piping.

The pump 21 is disposed upstream of the engine 10, and pumps the coolant into the engine 10. Since the engine 10 is heated during the operation, pumping by the pump 21 cools the engine 10.

The aforementioned temperature sensor (water temperature sensor) 30 is disposed downstream of the pump 21 (engine 10). The temperature sensor 30 can measure the temperature of the coolant that has passed through the engine 10. Further, the heater core 22 is disposed downstream of the temperature sensor 30. The heater core 22 absorbs the heat of the coolant through heat exchange while the temperature inside the vehicle is increased.

The radiator 23 is disposed downstream of the heater core 22, and cools the coolant that has passed through the heater core 22 through heat exchange. Further, the reserve tank 24 for storing the coolant is disposed between the radiator 23 and the pump 21. When the coolant to be fed to the pump 21 is in short supply, the coolant is fed from the reserve tank 24. In the present embodiment, the reserve tank 24 is disposed between the radiator 23 and the pump 21, but may be disposed in, for example, the radiator 23.

In the present embodiment, a flow channel where the coolant flows, which is formed in the engine 10, the pump 21, the heater core 22, and the radiator 23, and a flow channel within the piping that connects these components correspond to the "flow channel where the coolant flows" in the present disclosure.

The control device 40 controls starting of the engine 10 on the basis of a starting signal from the starter 50, and continuously controls combustion of the engine 10. The control of the engine 10 by the control device 40 is typical control for operating the engine 10, such as an air-fuel ratio control of the engine 10. The detailed description of the control will be omitted herein.

The control device 40 is connected to the warning light 60 and controls the warning light 60 to turn on when it is determined that the coolant needs to be exchanged. The control device 40 is connected to the temperature sensor 30, from which it receives a measurement signal of the temperature of the coolant. Further, the control device 40 is connected to the input device 70, via which a control program of the control device 40 is input.

Figure 2:
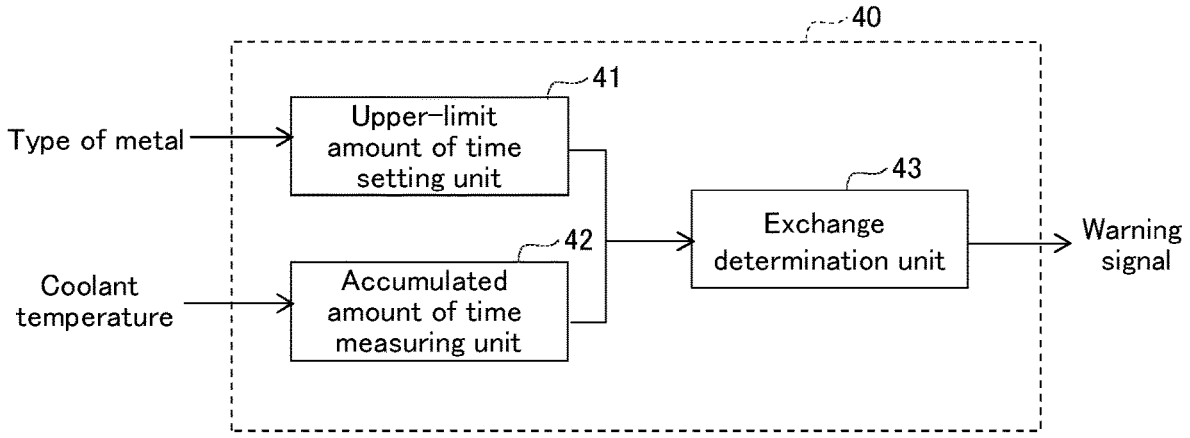
FIG. 2 is a block diagram showing control of the internal combustion system shown in FIG. 1.

The control device 40 includes, a calculation device (not shown) such as a CPU, and a storage device (not shown) such as a RAM and a ROM, as hardware. The control device 40 further includes, as software, an upper-limit amount of time setting unit (setting unit) 41, an accumulated amount of time measuring unit (measuring unit) 42, and an exchange determination unit (determination unit) 43 that are shown in FIG. 2. It should be noted that since the control of the engine 10 with software is commonly known, the detailed description of the control will be omitted herein.

The upper-limit amount of time setting unit 41 sets an upper-limit accumulated amount of time, which will be described later, in accordance with the type of metal forming the flow channel where the coolant flows in the cooling circulation mechanism 20. Herein, the upper-limit accumulated amount of time is used as a reference for determination (threshold) on whether the coolant needs to be exchanged. Setting of the upper-limit accumulated amount of time will be described in detail later.

The accumulated amount of time measuring unit 42 measures the accumulated amount of time when the coolant temperature measured by the temperature sensor 30 is equal to or higher than a defined temperature during the period until the coolant is exchanged. Herein, the defined temperature is a temperature at which the ethylene glycol contained in the coolant is oxidatively degraded so that an organic acid such as a formic acid or an acetic acid is produced, which is, for example, 80° C. Therefore, in this case, the accumulated amount of time measuring unit 42 continuously accumulates the amount of time when the condition that the temperature of the coolant is 80° C. or higher is satisfied, from the time when the coolant is previously exchanged.

The exchange determination unit 43 determines that the coolant needs to be exchanged when the accumulated amount of time measured by the accumulated amount of time measuring unit 42 reaches or exceeds the upper-limit accumulated amount of time set by the upper-limit amount of time setting unit 41. Specifically, when the exchange determination unit 43 determines that the coolant is deteriorated, the exchange determination unit 43 transmits a warning signal to prompt the coolant exchange to the warning light 60.

Figure 3:
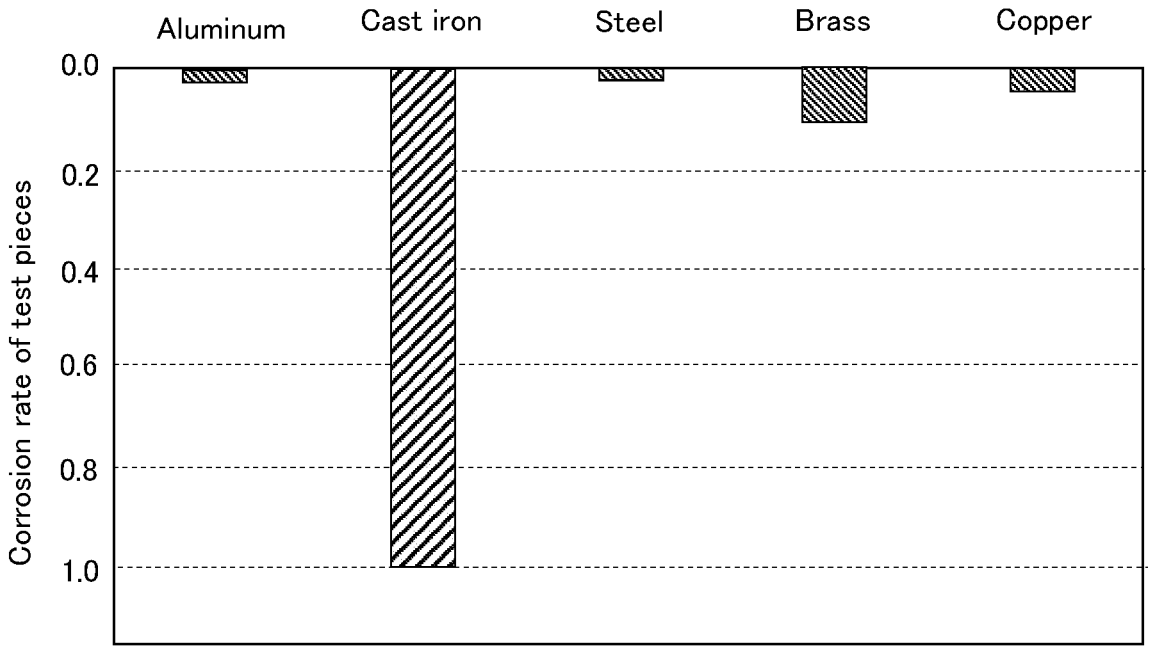
FIG. 3 is a graph showing the corrosion rates of test pieces.

As described above, the coolant flowing through the cooling circulation mechanism 20 receives heat from the engine 10 or the like to be heated, which may occasionally produce an organic acid from ethylene glycol contained in the coolant. Therefore, the inventors prepared test pieces corresponding to the types of metals forming the flow channel where the coolant flows. Specifically, five test pieces formed of aluminum, cast iron, steel, brass, and copper were prepared. These test pieces underwent a testing for metal corrosiveness against an antifreeze coolant that is compliant with JIS K2234. The results are shown in FIG. 3. The longitudinal axis of FIG. 3 represents the corrosion rate of each test piece, with the corrosion rate of cast iron as 1.0. The corrosion rate is a rate of reduction in weight of the test piece due to corrosion. A higher corrosion rate indicates a greater likelihood of corrosion.

As is obvious from FIG. 3, cast iron was the most corrosive, followed by brass and copper in this order. The corrosion rates of aluminum and copper were nearly the same. Since cast iron has carbon particles dispersed in the iron structure as the base material, the organic acid enters the grain boundary of the iron structure and thus corrosion at the grain boundary is likely to occur. Therefore, cast iron is considered more corrosive than the other metals.

In view of the foregoing, in the present embodiment, the upper-limit amount of time setting unit 41 sets the upper-limit accumulated amount of time as a reference for exchange determination by the exchange determination unit 43 in accordance with the type of metal forming the flow channel where the coolant flows in the cooling circulation mechanism 20. For example, as shown in FIG. 3, the upper-limit accumulated amount of time may be set shorter as the corrosion rate becomes higher (in the order of metals that are more likely to corrode). For example, the upper-limit accumulated amount of time may be set to be the shortest for cast iron having the highest corrosion rate, and the upper-limit accumulated amount of time may be set to be the longest for aluminum and copper having the lowest corrosion rate.

Further, when the flow channel where the coolant flows includes a plurality of metals, the upper-limit amount of time setting unit 41 sets the upper-limit accumulated amount of time corresponding to a metal that is most corrosive among the plurality of metals. For example, when the flow channel where the coolant flows includes members made from cast iron, copper, and steel, the upper-limit amount of time setting unit 41 sets the upper-limit accumulated amount of time corresponding to cast iron. Further, when the flow channel where the coolant flows includes members made from brass, aluminum, and steel, the upper-limit amount of time setting unit 41 sets the upper-limit accumulated amount of time corresponding to the brass. In this manner, since the upper-limit accumulated amount of time is set in accordance with the type of metal, even when the flow channel of the coolant includes a corrosive metal such as cast iron, the coolant can be exchanged before the concentration of the organic acid increases to the extent that the cast iron or the like corrodes, thereby enabling to suppress the corrosion of the flow channel of the coolant.

Figure 4:
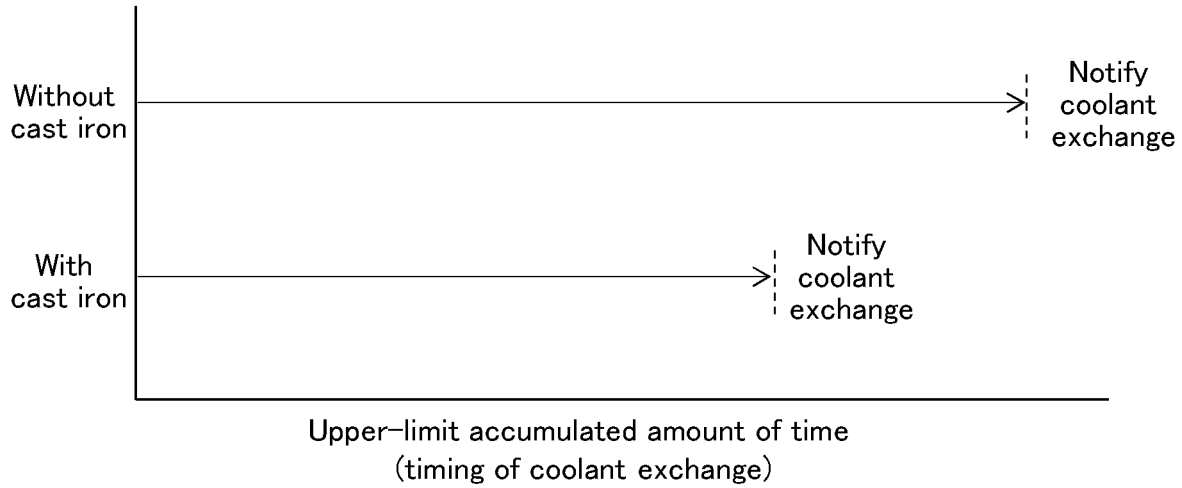
FIG. 4 is a conceptual view for explaining an upper-limit accumulated amount of time for each of cases in which metal forming a flow channel where the coolant flows includes cast iron and does not include cast iron.

It should be noted that according to the results shown in FIG. 3, since cast iron corrodes more excessively due to the organic acid as compared to the other metals, the upper-limit accumulated amount of time may be set for cast iron separately from the other metals. Specifically, the upper-limit amount of time setting unit 41 sets the upper-limit accumulated amount of time separately for cast iron in a case where the metal forming the flow channel includes the cast iron and for another metal in a case where the metal forming the flow channel does not include the cast iron. Specifically, as shown in FIG. 4, the upper-limit amount of time setting unit 41 sets the upper-limit accumulated amount of time for cast iron (a case with cast iron) to be shorter than those for metals other than the cast iron (a case without cast iron).

As a result, for a case where the metal forming the flow channel includes cast iron (that is, at least part of the flow channel includes a cast-iron component), the coolant is exchanged in a shorter upper-limit accumulated amount of time as compared to the other metals. Thus, the corrosion of the cast iron (corrosion of the cast-iron component) can be reduced. Meanwhile, for a case where the metal forming the flow channel does not include cast iron (that is, the flow channel does not include any cast-iron component), the coolant is exchanged in a longer upper-limit accumulated amount of time as compared to cast iron. Thus, the frequency of the coolant exchange can be reduced.

Figure 5:
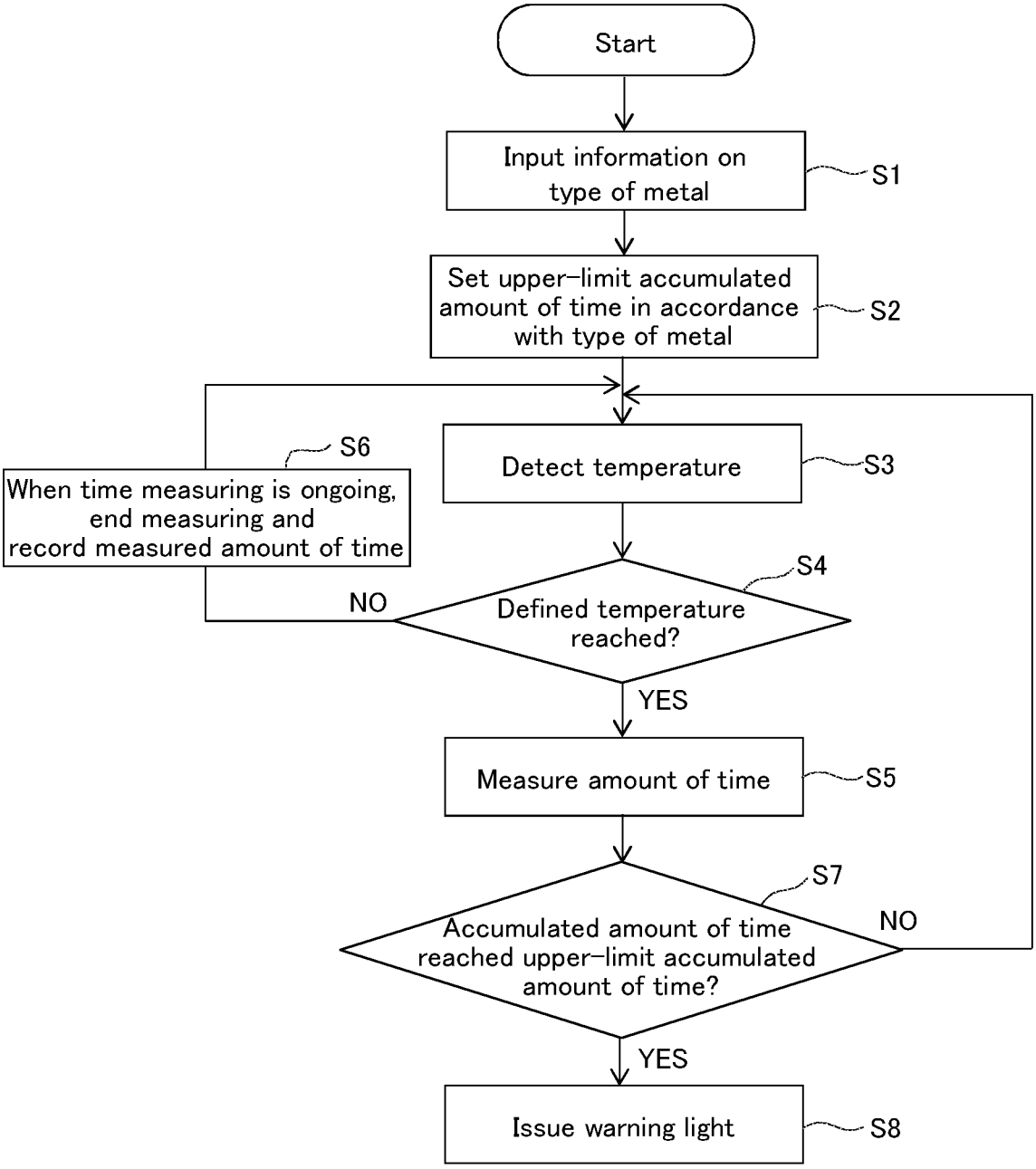
FIG. 5 is a flowchart of control of the internal combustion system according to the embodiment of the present disclosure.

With reference to FIG. 5, the control flow of the internal combustion system of the present embodiment will be described. First, in step S1, information on the type of metal forming the flow channel where the coolant flows is input via the input device 70. For example, when the flow channel includes a plurality of types of metals, all types of metals are input.

Next, the process proceeds to S2, where the upper-limit amount of time setting unit 41 sets an upper-limit accumulated amount of time in accordance with the type of metal forming the flow channel where the coolant flows. Specifically, for a case where the metal that is input in step S1 includes cast iron, the upper-limit accumulated amount of time for cast iron is set, and for a case where the metal does not include cast iron, the upper-limit accumulated amount of time for a metal other than cast iron is set.

Then, in step S3, the engine 10 is started and then the temperature sensor 30 measures the temperature of the coolant. The process proceeds to step S4, where the accumulated amount of time measuring unit 42 determines whether the temperature of the coolant has reached a defined temperature.

Herein, in step S4, when the temperature of the coolant has reached a defined temperature (temperature at which an organic acid is produced), the process proceeds to step S5, where the accumulated amount of time measuring unit 42 measures the amount of time (specifically, measured time is added). In this manner, the accumulated amount of time measuring unit 42 can calculate the accumulated amount of time by accumulating the amount of time when the temperature of the coolant reaches or exceeds a defined temperature.

Meanwhile, when the temperature of the coolant has not reached the defined temperature, the process proceeds to step S6. In step S6, if measuring of the amount of time is already ongoing, the time measuring ends and the measured time is stored. Then, the process returns to step S3.

In step S5, the accumulated amount of time measuring unit 42 measures (calculates) the accumulated amount of time, and then the process proceeds to step S7, where the exchange determination unit 43 determines whether the accumulated amount of time has reached the upper-limit accumulated amount of time. When the accumulated amount of time has reached the upper-limit accumulated amount of time, the process proceeds to step S8. Meanwhile, when the exchange determination unit 43 determines that the accumulated amount of time has not reached the defined time, the process returns to step S3 and the measuring of the temperature of the coolant continues.

In step S8, the exchange determination unit 43 transmits a warning signal to the warning light 60 to turn it on. Once the coolant is exchanged, the measured accumulated amount of time is reset and the flow shown in FIG. 5 is restarted.

Although the embodiment of the present disclosure has been described in detail above, the present disclosure is not limited thereto, and any design changes can be made without departing from the spirit of the present disclosure described in the claims.

The present embodiment shows an example of a single control device to be mounted on a vehicle, which performs the engine control, determination of the coolant deterioration, and warning light control. However, the control of the warning light shown in FIG. 2 may be performed such that a control device is provided in an external management system of the vehicle so as to control the warning light through communication via the management system.

What is claimed is:

1. An internal combustion system comprising:

an engine;

a cooling circulation mechanism that circulates a coolant to the engine while cooling the coolant, the coolant adapted to cool the engine and containing ethylene glycol;

a temperature sensor that measures a temperature of the coolant having passed through the engine; and a control device having:

a measuring unit that measures an accumulated amount of time by measuring an amount of time when the temperature of the coolant measured by the temperature sensor is equal to or higher than a defined temperature and accumulating the amount of time measured;

a determination unit that determines that the coolant needs to be exchanged when the accumulated amount of time measured reaches or exceeds an upper-limit accumulated amount of time; and a setting unit that sets the upper-limit accumulated amount of time for determination by the determination unit in accordance with a type of metal forming a flow channel where the coolant flows in the cooling circulation mechanism.

2. The internal combustion system according to claim 1, wherein the setting unit sets:

the upper-limit accumulated amount of time separately for cast iron in a case where the metal forming the flow channel includes the cast iron and for another metal in a case where the metal forming the flow channel does not include the cast iron, and the upper-limit accumulated amount of time for the cast iron to be shorter than the upper-limit accumulated amount of time for the other metal.

* * * * *